US005304901A

United States Patent [19]

Mori

[11] Patent Number: 5,304,901

[45] Date of Patent: Apr. 19, 1994

[54] ROTATION CONTROL DEVICE FOR SEWING MOTOR

[75] Inventor: Shushin Mori, Nagoya, Japan

[73] Assignee: Brother Kogyo Kabushiki Kaisha, Aichi, Japan

[21] Appl. No.: 896,432

[22] Filed: Jun. 10, 1992

[30] Foreign Application Priority Data

Nov. 28, 1990 [JP] Japan ..... 2-331902

[51] Int. Cl.[5] ..... D05B 69/18

[52] U.S. Cl. ..... 318/164; 112/275; 318/162; 318/127

[58] Field of Search ..... 318/256, 257, 115, 126, 318/127, 162, 163, 164, 282, 286, 443, 563, 566, 671, 686; 112/220, 221, 254, 255, 271, 275

[56] References Cited

U.S. PATENT DOCUMENTS 4,541,349 9/1985 Inoue ..... 112/221
4,765,267 8/1988 Nakamura ..... 112/275
5,018,466 5/1991 Hasegawa ..... 112/275

FOREIGN PATENT DOCUMENTS

0112949A1 7/1984 European Pat. Off. .
0366140A1 5/1990 European Pat. Off. .
22495660A 5/1992 United Kingdom .

*Primary Examiner*—Bentsu Ro
*Attorney, Agent, or Firm*—Oliff & Berridge

[57] ABSTRACT

When a sewing machine is locked during stitching of a thick fabric, the rotational direction of a sewing motor is alternately reversed at a predetermined time interval. A needle operatively coupled to the sewing motor through a mechanical system is moved up and down, whereby the needle sticks into the same stitching point for a desired number of times.

10 Claims, 5 Drawing Sheets

ROTATION CONTROL DEVICE FOR SEWING MOTOR

BACKGROUND OF THE INVENTION

The present invention relates to a rotation control device for a sewing motor.

Heretofore, a sewing motor is controlled so as to be rotate and brake in accordance with a predetermined sequence known as invertor drive. In such a rotation control device, if the output torque of the sewing motor is excessively large, an undue load is imposed on a mechanical system at the time of acceleration or deceleration of the sewing motor. Hence the mechanical system is liable to be damaged. To prevent the sewing mechanism from being imposed on an excessive load, the current flowing in each winding of the motor is set to be less than a maximum allowable level.

However, the limitation of the motor torque weakens the penetrating force of a needle when stitching a thick fabric. An industrial sewing machine, in particular, is often required to sew a very thick work having a plurality of superimposed thick fabrics. In some cases, the D.C. motor is nearly locked in sewing such a very thick work due to the high resistance of the very thick work to the penetrating action of a needle.

In the sewing machine of the type having an arrangement wherein the driving force generated from the sewing motor is transmitted to the mechanical system through a transmission belt and pulleys, the torque to be transmitted to the mechanical system can be increased if the diameter of the motor pulley is reduced. However, if this is done, the maximum driving speed which may otherwise be achieved if the diameter of the motor pulley is remained unchanged is adversely lowered.

SUMMARY OF THE INVENTION

The present invention has been made to solve the aforementioned problem, and accordingly it is an object of the present invention to provide a rotation control device for a sewing motor which can enhance the sewing capability of a sewing machine without lowering the maximum driving speed of the sewing machine.

To achieve the above and other objective, the present invention provides a rotation control device for a sewing machine, the sewing machine being driven within a predetermined range between a minimum driving speed and a maximum driving speed, comprising: (a) a sewing motor rotatable at a speed in both first and second directions opposite to each other; (b) rotational speed controlling means for controlling a rotational speed of the sewing motor in response to a speed instruction; (c) direction instructing means for instructing a rotational direction of the sewing motor; (d) detecting means for detecting the rotating speed of the sewing motor and outputting a speed signal indicative of the detected rotating speed; (e) decision means for deciding whether the detected rotating speed of the sewing motor is lower than a minimum rotating speed of the sewing motor determined by the minimum driving speed of the sewing machine and outputting a decision signal indicative of the decision made by the decision means; and (f) reversing/repeating means responsive to the decision signal for controlling the direction instructing means so that the rotational direction of the sewing motor is alternately reversed at a predetermined time interval.

In operation, the rotational speed controlling means controls the rotational speed of the sewing motor in response to the speed instruction, whereby the sewing machine starts driving. The sewing motor is normally controlled so as to rotate in the first direction (or forward direction), and a mechanical system of the sewing machine is activated by the driving force transmitted from the sewing motor. A needle is moved up and down and the stitching of a fabric is performed. If a thick fabric is to be stitched, the needle may not penetrate into the fabric due to the resistance of the fabric. If this occurs, the rotational speed of the sewing motor is lowered below the minimum rotating speed determined by the minimum driving speed. Then the decision means decides that the rotational speed of the sewing motor is lower than the minimum rotating speed, whereupon the reversing/repeating means controls the direction instructing means so that the rotational direction of the sewing motor is alternately reversed the predetermined time interval. The reversal of the motor rotational direction is within a movable range of the needle between the upper dead point and the lower dead point.

In this manner, the rotational direction of the sewing motor is repeatedly reversed in a given period, causing to draw the needle out of the fabric and then to stick the needle into the same point on the fabric. By such actions of the needle, it can finally penetrate into the fabric. The resistance of the fabric exerted on the needle is substantially zeroed when the needle is fully penetrated into the fabric. As a result, the rotational speed of the sewing motor is increased and exceeds the minimum rotating speed. The sewing motor is then controlled to rotate in the first direction or forward direction in response to the speed instruction.

BRIEF DESCRIPTION OF THE PREFERRED EMBODIMENTS

The particular features and advantages of the invention as well as other objectives will become apparent from the following description taken in connection with the accompanying drawings, in which.

DETAILED DESCRIPTION OF THE PREFERRED EMBODIMENTS

Figure 1:
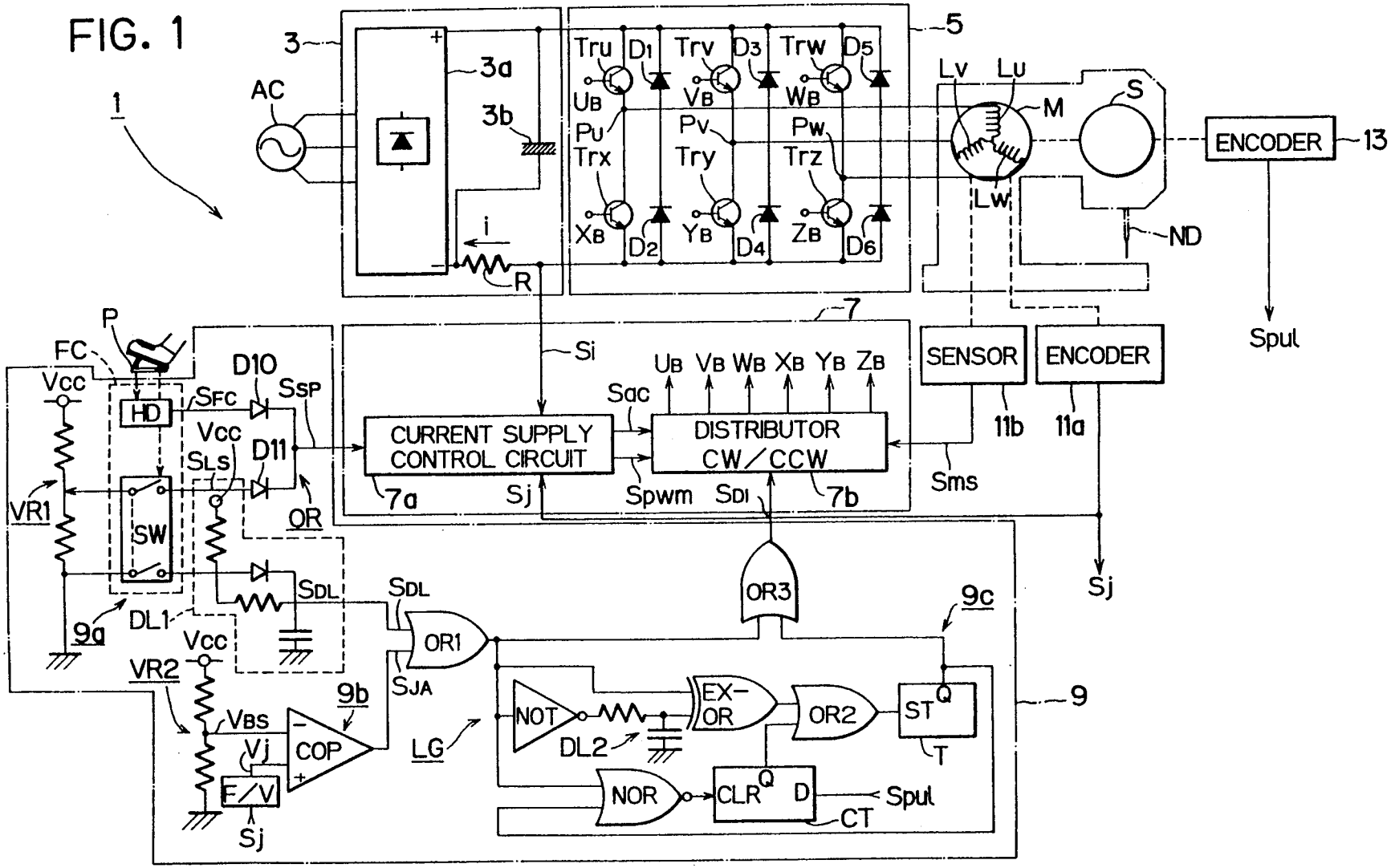
FIG. 1 is an electrical circuit diagram showing a rotation control device for a sewing machine according to an embodiment of the invention.

A preferred embodiment of the present invention will now be described with reference to the accompanying drawings. FIG. 1 is an electrical circuit diagram showing a rotation control device for a sewing machine according to the preferred embodiment of the invention.

An A.C. motor M is used for a sewing motor. The driving power of the A.C. motor M is transmitted through a transmission mechanism (not shown) to a mechanical system S, whereby a sewing needle ND is vertically moved up and down. The A.C. motor M normally rotates in forward direction and the needle ND repeats up-and-down movement in accordance with the forward rotation of the motor. However, when the sewing machine is locked during stitching of a thick fabric, the mechanical system S moves descending needle ND to elevate or ascending needle ND to lower by rotating the A.C. motor M in the reverse direction, as will be described in detail below.

At the lower portion of a sewing machine table (not shown), there is provided a foot controller FC. The foot controller FC includes a Hall element HD which outputs an instruction signal SFC for instructing a rotational speed of the A.C. motor M depending on the depression degree of a foot pedal P. The foot controller FC further includes a double-throw switch SW which is rendered ON when the foot pedal P is depressed. The foot pedal P has a play wherein when the pedal is slightly depressed, the switch SW is rendered ON but the Hall element HD does not issue the instruction signal SFC. The instruction signal SFC is issued when the foot pedal P is depressed to a deeper level.

As shown, the rotation control device 1 includes a D.C. power source 3, a current supplying section 5, a current supply control section 7, a rotation instructing section 9, an encoder 11*a*, a magnetic sensor 11*b*, and another encoder 13. Being supplied with an A.C. current, the D.C. power source 3 rectifies the A.C. current and supplies the D.C. current to the current supply section 5 which in turn supplies the D.C. current to the windings of the A.C. motor M under the aegis of the current supply control section 7. The rotation instructing section 9 provides instructions regarding the rotational speed and the rotational direction of the A.C. motor M to the current supply control section 7. The encoder 11*a* senses the rotational speed of the A.C. motor M, and the magnetic sensor 11*b* senses the rotational phase of the A.C. motor M. The encoder 13 senses the rotational angle of a drive shaft, i.e. arm shaft (not shown), of the mechanical system S.

The D.C. power source 3 includes a diode bridge circuit 3*a* serving as a rectifying circuit as is well known in the art, and a smoothing capacitor 3*b*. A current detecting resistor R is connected to the negative pole of the diode bridge circuit 3*a* for detecting a current i flowing in the A.C. motor M.

The current supplying section 5 is a so-called invertor which includes six power transistors Tru, Trv, Trw, Trx, Try and Trz for intermittently supplying currents to the respective phase windings Lu, Lv and Lw of the A.C. motor M, and six communication diodes D1 through D6 for regenerating electric charges from the phase windings Lu, Lv and Lw. The phase winding Lu is connected to a junction Pu of the transistors Tru and Trx, the phase winding Lv is connected to a junction Pv of the transistors Trv and Try, and the phase winding Lw is connected to a junction Pw of the transistors Trw and Trz.

The current supply control section 7 controls current supplying times at which currents are supplied to the respective phase windings Lu, Lv and Lw as well as a current supplying sequence, whereby the rotational speed and the rotational direction of the A.C. motor M is controlled. The current supply control section 7 includes a current supply control circuit 7*a* for producing a current supply control signal Spwm, and a distributor 7*b* for outputting switching pulses UB, VB, WB, XB, YB and ZB to the bases of the transistors Tru, Trv, Trw, Trx, Try and Trz, respectively, based on the current supply control signal Spwm.

The current supply control circuit 7*a* produces a current supply control signal Spwm in the form of PWM (pulse width modulation) signal and an acceleration/deceleration instruction signal Sac based on a speed instruction signal SSP fed from the rotation instructing section 9 and a speed detection signal Sj fed from the encoder 11*a*. The current supply control signal Spwm determines both a current supply period and a current supply duration, and the acceleration/deceleration instruction signal Sac instructs either acceleration or deceleration of the motor rotation. The current supply control signal Spwm and the acceleration/deceleration instruction signal Sac thus produced from the circuit 7*a* are outputted to a distributor 7*b*. Based on the current detection signal Si derived from the current detecting resistor R, the maximum pulse width of the current supply control signal Spwm is limited to thereby limit the current i flowing in the A.C. motor M to be less than a predetermined limit value.

The rotational speed N of the A.C. motor M is determined depending on a duty ratio of the current supply control signal Spwm. The currents flowing in the phase windings Lu through Lw increase as the duration or pulse width of the current supply control signal Spwm is prolonged, speeding up the rotational speed of the motor M. At the time of deceleration, the braking torque is increased when the duration of the control signal Spwm is prolonged.

The distributor 7*b* is comprised of logic elements well known in the art. The distributor 7*b* applies switching pulses UB through ZB to the bases of the transistors Tru through Trz to thereby perform ON-OFF control of these transistors based on the current supply control signal Spwm and a magnetic pole detection signal Sms fed from the magnetic sensor 11*b*, so that the respective phase windings Lu, Lv and Lw are supplied with currents in a forward rotational sequence or reverse rotational sequence. Either of the rotational sequence is instructed by a rotational direction instruction signal SDI fed from the rotation instructing section 9. The rotational direction instruction signal SDI provides an instruction regarding the rotational direction of the motor, i.e. either the forward rotation CS or reverse rotation CCW.

The rotation instructing section 9 includes a speed instruction circuit 9*a*, a decision circuit 9*b* for determining whether the rotational speed N of the A.C. motor falls below a predetermined very slow speed NBS to be described later, and a rotational direction change-over instruction circuit 9*c* for instructing the rotational direction changeover of the A.C. motor M based on a decision signal SJA fed from the decision circuit 9*b* and a rotational angle detection signal Spul from the encoder 13. The speed instruction circuit 9*a* sets a voltage corresponding to a minimum rotational speed NLS of the A.C. motor M when it is driven under a standard driving condition. The circuit 9*a* includes a voltage setter VR1 which outputs a minimum speed instruction signal SLS, a wired logic OR circuit OR made up of two diodes D10 and D11 for outputting either one of the instruction signal SFC fed from the foot controller FC and the minimum speed instruction signal SLS fed from the voltage setter VR1. The speed instruction circuit 9*a* further includes a delay circuit DL1 which produces a delay signal SDL (low active) to the rotational direction changeover instruction circuit 9*c*. The delay signal SDL is changed from high to low after elapse of a predetermined period of time from the time when the foot controller switch SW is rendered on.

Figure 2:
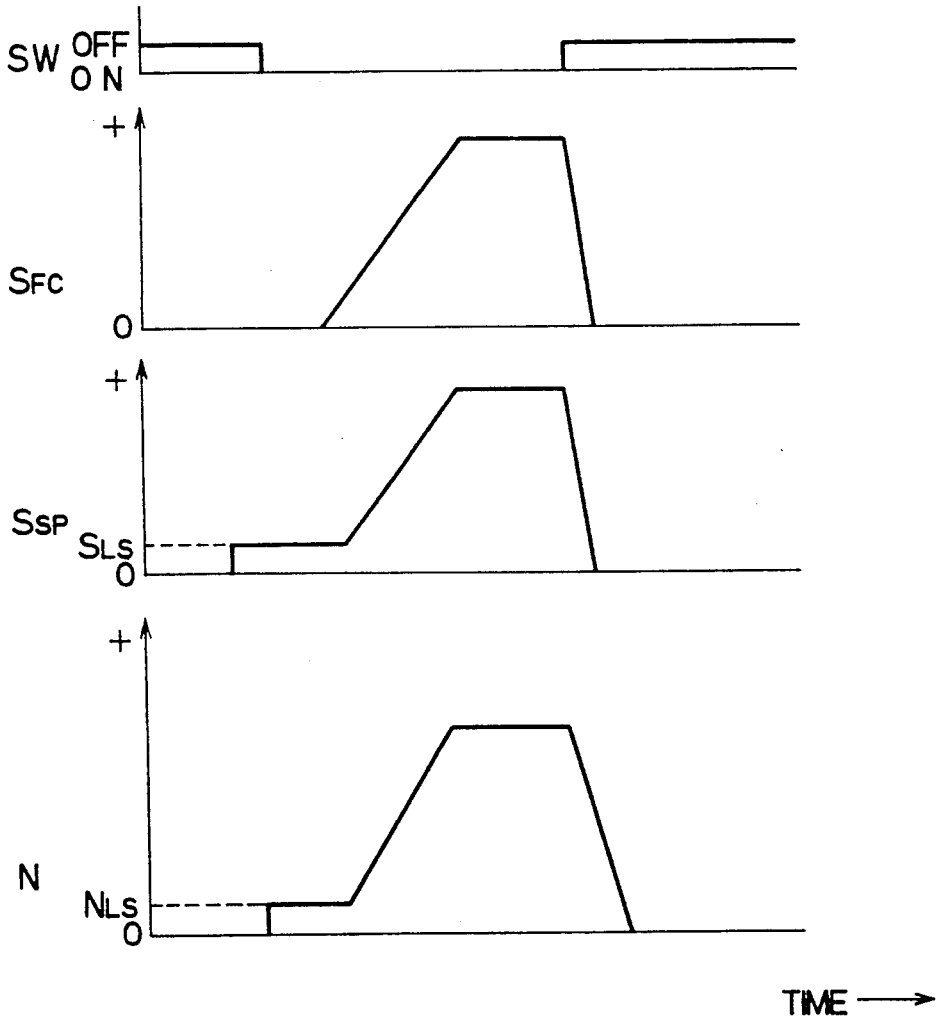
FIG. 2 is an explanatory diagram for description of a changeover of a speed instruction signal.

As shown in FIG. 2, the wired logic OR circuit OR outputs a minimum speed instruction signal SLS when the pedal P of the foot controller FC is slightly depressed, and a speed instruction signal SFC when the pedal P is depressed to a deeper level. Both signals SLS and SFC are generally referred to as speed instruction signals SSP. The speed instruction signal SSP increments depending on the depressing level of the pedal and decrements depending on the retracting level of the pedal.

The decision circuit 9b includes a comparator COP, a frequency-to-voltage (F/V) converter well known in the art which converts the speed detection signal (pulse) Sj to a speed voltage (dc level) Vj corresponding to the rotational speed N, and a voltage setter VR2 for setting a very low speed voltage VBS corresponding to the very low speed NBS of the A.C. motor M. The comparator COP compares the voltage Vj with the voltage VBS and outputs a decision signal SJA (high active) to the rotational direction changeover instruction circuit 9c when the speed voltage Vj falls below the very low speed voltage VBS. The very low speed NBS of the A.C. motor M is lower than the minimum rotational speed NLS and is determined depending on the minimum rotational speed within the A.C. motor rotatable range which in turn is determined depending on the electrical arrangement of the A.C. motor M and the mechanical arrangement of the sewing machine mechanical system S. The minimum rotational speed NLS is determined depending further on the sewing result of a very thick fabric.

The rotational direction changeover instruction circuit 9c includes a counter CT, a timer T, and a logic circuit LG. The circuit 9c outputs the rotational direction instruction signal SDI. The signal SDI is at a high level when instructing the forward rotation CW of the motor M whereas the signal SDI is at a low level when instructing the reverse rotation CCW.

The output of the timer T changes from low to high when time measurement is carried out. Upon measurement of a predetermined period of time t, the output of the timer T changes from high to low. The counter CT counts the number of pulses of the rotational angle detection signal Spul and outputs one-shot pulse when a predetermined number of the pulses n are counted.

The logic circuit LG includes a first logic OR gate OR1 having a first input applied with the delay signal SDL fed from the speed instruction circuit 9a and a second input applied with the decision signal SJA fed from the decision circuit 9b, and an exclusive-OR gate having a first input connected to the output of the first OR gate OR1 and a second input connected to the first OR gate OR1 through a NOT gate and a delay circuit DL2 for inverting and delaying the ORed signal of the first OR gate OR1. The logic circuit LG further includes a second OR gate OR2 having a first input connected to the output of the exclusive-OR gate and a second input connected to the counter CT, a NOR gate having a first input connected to the output of the first OR gate OR1 and a second input connected to the timer T, and a third OR gate OR having a first input connected to the output of the first OR gate OR1 and a second input connected to the output of the timer T. The third OR gate OR3 produces the rotational direction instruction signal. It should be noted that the outputs of the logic gates OR1 through OR3, NOT gate, exclusive-OR gate, NOR gate, the counter CT and the timer T are active high.

When the output of the first OR gate OR1 is at a high level, the output of the third OR gate OR3, i.e., the rotational direction instruction signal SDI is at a high level which instructs the A.C. motor M to forwardly rotate (CW). At this time, the output of the exclusive-OR gate is at a low level, the output of the NOR gate is at a low level, and the counter CT has been reset. Therefore, the output of the second OR gate OR2 is at a low level and thus the timer T does not start measuring time.

When the output of the first OR gate OR1 changes from high to low, the output of the exclusive-OR gate remains high for a brief period of time determined by the delay time of the delay circuit DL2. The timer T is triggered by the high level signal of the exclusive-OR gate and starts measuring time. Accordingly, the output of the timer T is rendered high, so that the output of the third OR gate OR3 remains at a high level and thus the instruction to forwardly rotate the motor is continuously applied to the distributor 7b.

When the output of the timer T changes from high to low upon completion of the time measurement, the output level of the third OR gate OR3 changes from high to low, thereby providing an instruction SDI to the distributor 7b so as to rotate the motor M in reverse direction CCW. At the same time, the output level of the NOR gate changes from low to high and the counter CT starts counting the pulses. When the counter CT outputs a pulse upon counting a predetermined number of pulses, the output level of the second OR gate OR2 remains high for a brief period of time. This triggers the timer T and the time measurement is again started. Accordingly, the output level of the third OR gate OR3 is changed to high and thus the motor M is instructed to rotate in forward direction (CW) by the distributor 7b.

Figure 3:
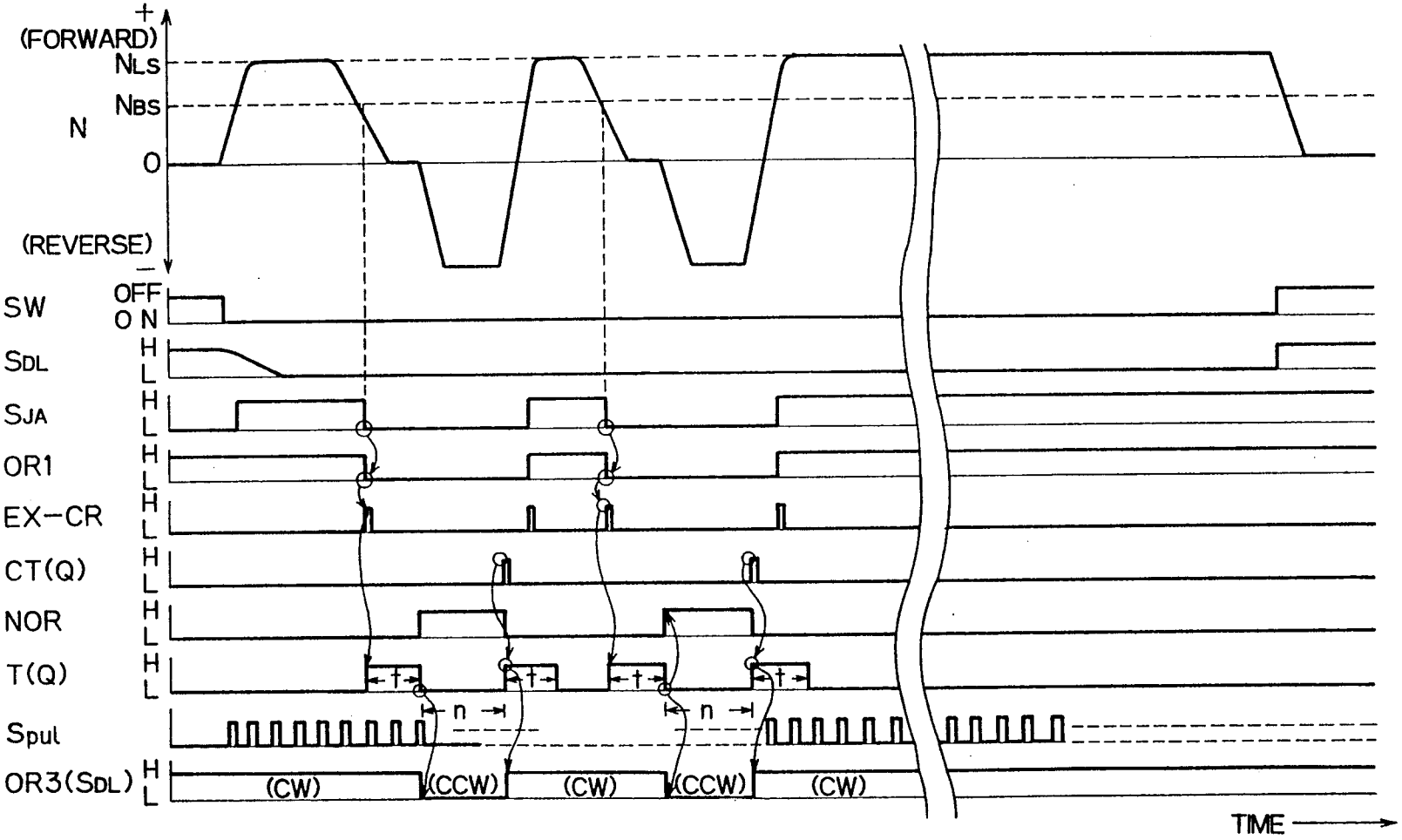
FIG. 3 is a timing chart for description of operation of the rotation control device.

Operation of the rotation control device 1 thus arranged will be described with reference to the timing chart shown in FIG. 3. In the following description, it is assumed that a thick fabric is stitched while driving the sewing machine at a constant minimum rotational speed NLS.

When the pedal P is slightly depressed, the switch SW is turned on and the motor is instructed to rotate at the minimum rotational speed NLS (SSP=SLS). At the same time, the output level of the delay circuit DL1 starts lowering and is brought to low level after a predetermined period of time from the time when the switch SW is turned on. During this delay time, the rotational speed N of the motor M exceeds the very low speed NBS, so that the decision signal SJA issued from the decision circuit 9b changes to high and thus the output of the first OR gate OR1 is maintained at high level. Therefore, after the switch SW is turned on, the output of the third OR gate OR3 remains at high level and the instruction to rotate the motor M in the forward direction (CW) is provided to the distributor 7b.

Now that the pedal is held in a slightly depressed condition, the rotational speed N of the motor M is maintained at the minimum rotational speed NLS and thus the sewing machine starts stitching the thick fabric. It is assumed that strong resistance is applied to the needle ND in the course of stitching the thick fabric, the rotational speed N of the motor M is lowered below the very low speed NBS due to the load imposed on the motor, and finally the motor M is locked. In such a situation, the decision signal SJA from the decision circuit 9b is changed from high to low and accordingly the output of the first OR gate OR1 changes to low. However, the timer T has started measuring time and the output of the timer T has been at a high level. Therefore, the output (SDI) of the third OR gate OR3 is maintained at a high level and the instruction to rotate the motor in the forward direction (CW) is continuously applied to the distributor 7*b*.

Upon completion of the time measurement by the timer T, the output level (SSI) of the third OR gate OR3 changes to low and the motor M is instructed to rotate reversely (CCW). At the same time, the counter CT starts counting the pulses and hence the needle ND is elevated and is drawn out of the fabric. The counter CT counts the number of pulses of the rotational angle detection signal applied when the needle ND is elevating.

When the counter CT counts a predetermined number of pulses n, the timer T starts measuring time again. The output SDI of the third OR gate OR3 changes to high and the motor M is instructed to rotate in forward direction (CW). Then, the motor M rotates in the forward direction and its rotational speed N exceeds the very low speed NBS. As a result, the decision signal SJA is raised to high and the output of the first OR gate OR1 is changed to high. Accordingly, even if the time measurement by the timer T is complete, the output SDI of the third OR gate OR3 is maintained a high level and the instruction to forwardly rotate the motor M is continued.

Consequently, the needle ND which has been elevated now starts lowering and again sticks into the same stitching point on the fabric. If the needle ND cannot penetrate into the fabric with the second stick, the motor M is reversed and then forwardly rotated again as described above. If the needle ND eventually penetrates into the superimposed portion of the fabric with the third stick and the stitching of that portion is complete, the rotational speed N of the motor M exceeds the minimum rotational speed NLS and then the motor M keeps on rotating at a constant speed. The stitching of the fabric continues in this condition.

As described, stitching a very thick fabric, the up and down movement of the needle ND is repeatedly carried out until the needle ND finally sticks into the stitching point.

The forwardly rotating period and the reversely rotating period of the motor M when the needle ND makes up and down movements are determined based on various factors which includes inertia of the motor M, a load inertia of the sewing machine mechanical system S, a response delay of the sewing machine as determined by a tension of a belt (not shown) of the transmission mechanism, i.e., a time at which the driving speed of the sewing machine reaches a speed corresponding to the speed instruction signal SSP, and a time constant of the motor M, i.e., a time at which the motor current i reaches a level corresponding to the speed instruction signal SSP from the occurrence of the latter signal. These factors are obtained through actual measurements.

It sometimes takes time to complete the stitching of a thick fabric, since the needle ND gradually penetrates into the deeper level of the fabric while overcoming the resistance of the fabric. The measurement time t of the timer T and the time at which the rotational direction of the motor M is reversed are determined by taking the possible prolonged stitching into account. The count number n of the counter CT is set so as to not exceed the number of pulses which are counted during a single upward movement of the needle ND moving from the lower dead point to the upper dead point.

As described, when the rotational speed N of the motor M falls below the very low speed NBS, the motor M is reversely rotated and then forwardly rotated again so that the needle ND sticks into the same stitching point. Therefore, the needle ND can finally penetrate into the thick fabric. Further, if the needle ND cannot penetrate into the fabric in one stitch trial, other stitch trials follow until the needle ND penetrates into the fabric. Therefore, an extremely thick fabric can be stitched. In the present invention, the sewing capability can be enhanced without lowering the maximum driving speed of the sewing machine, unlike the conventional sewing machine. Furthermore, an undue load is not imposed on the mechanical system of the sewing machine when the motor output is increased, therefore the durability of both the motor M and the sewing machine can be extended.

While in the preferred embodiment of the invention, the motor M is reversely rotated and then forwardly rotated again when the rotational speed N of the motor M falls below the minimum rotational speed NLS, the motor rotational direction changeover operation may be performed when the rotational speed N of the motor M falls below the minimum rotational speed NLS and a deviation between the minimum rotational speed NLS and the real rotational speed becomes greater than a predetermined level, or when the rotational speed N of the motor M falls below the minimum rotational speed NLS and the motor current i has reached the limited current level.

Further, according to the preferred embodiment of the invention, the reverse/forward changeover driving of the motor M is repeatedly carried out until the needle ND penetrates into the fabric. However, a modification can be made so that if the needle ND cannot penetrate into the fabric with a first stitch trial or first and second stitch trials, the motor M is momentarily deenergized and the reverse/forward changeover driving of the motor is manually performed while manipulating a manual switch. Such a manual operation is advantageous in that the operator can perform further stitch trials while observing the condition of the fabric or the needle ND. If the operator feels that the needle ND is likely to be broken in light of the property or nature of the fabric, then he can manually rotate the arm shaft for further stitching.

Figure 4:
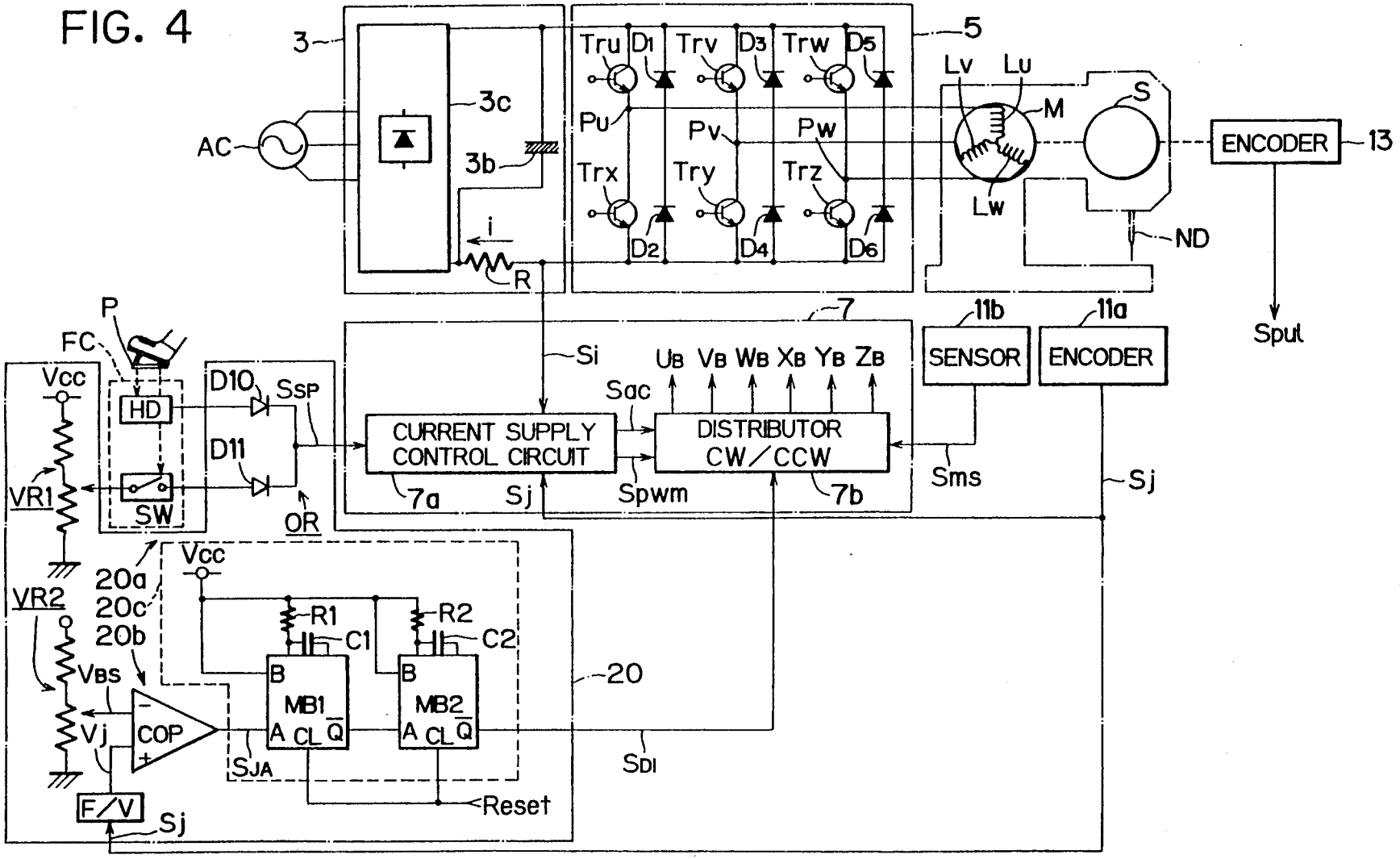
FIG. 4 is an electrical circuit diagram showing a rotation control device employing a different rotational direction changeover instruction circuit.

In the embodiment described, the rotational direction change-over instruction circuit 9*c* is constituted primarily with counter CT, timer T and logic circuit LG, the circuit 9*c* can be formed with monostable multivibrators. More specifically, as shown in FIG. 4, the rotational direction change-over instruction circuit 20*c* includes a first monostable multivibrator MB1, and a second monostable multivibrator MB2. The first monostable multivibrator MB1 produces a one-shot pulse SP1 (low active) having a predetermined duration t1 at a rising time of the decision signal SJA fed from the decision circuit 20*b*. In timed relation to the rising of the one-shot pulse SP1, the second monostable multivibrator MB2 produces a one-shot pulse SP2 (low active) having a predetermined duration t2. The one-shot pulse SP2 is used as the rotational direction instruction signal SDI. In this modification, the delay circuit DL1 of the speed instruction circuit 20*a* is dispensed with.

Figure 5:
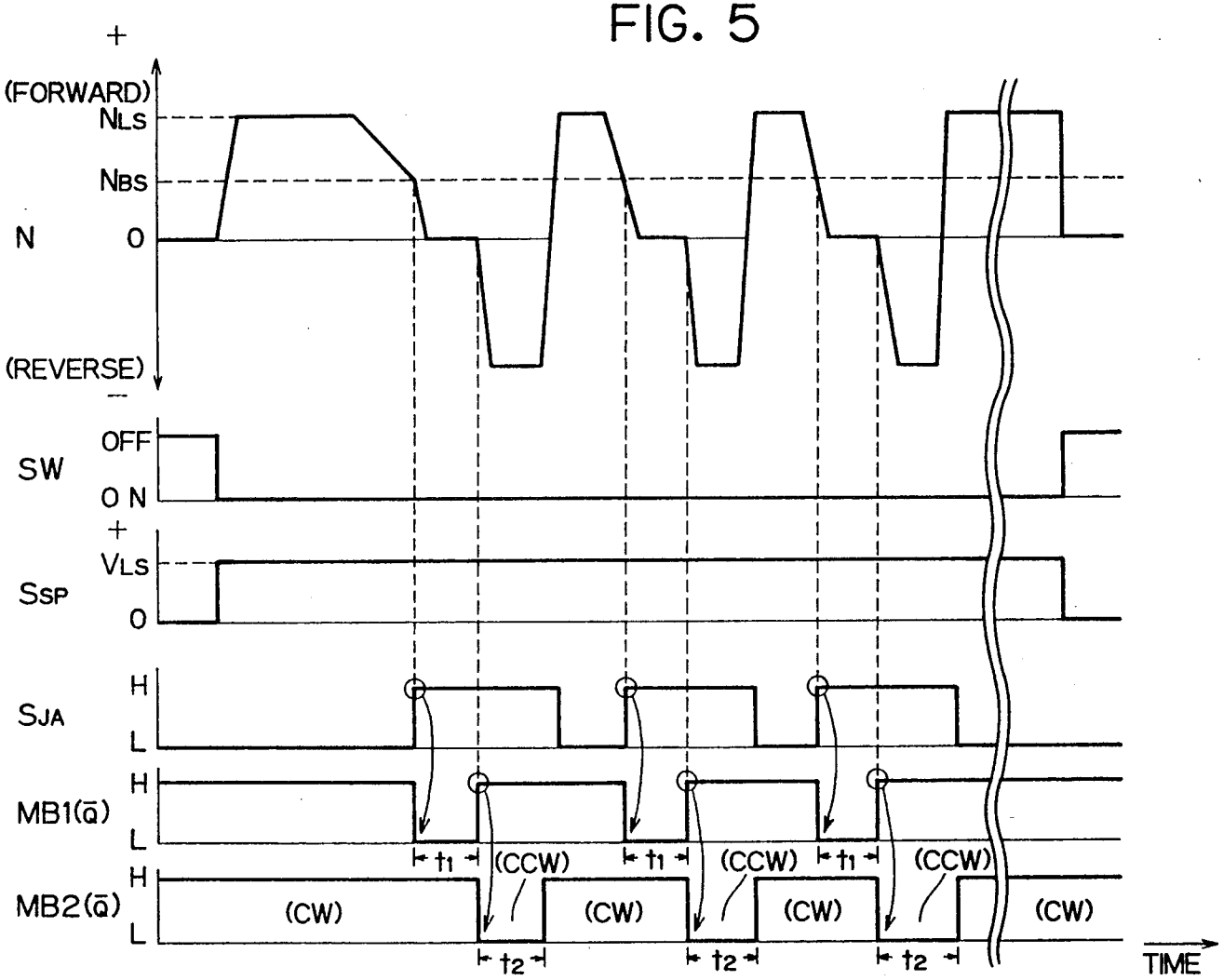
FIG. 5 is a timing chart for description of operation of the device shown in FIG. 4.

As shown in FIG. 5, in the rotational direction changeover instruction circuit 20c, the forward rotation (CW) of the motor M is instructed when the one-shot pulse SP2 (SD1) is non-active whereas the reverse rotation (CCW) of the motor M is instructed when the one-shot pulse SP2 is active. Resistor R1 and capacitor C1 are provided to the monostable multivibrator MB1 so that the predetermined duration t1 of the one-shot pulse produced therefrom is equal to the measuring time t to be measured by the timer T. Resistor R2 and capacitor C2 are provided to the monostable multivibrator MB2 so that the duration t2 of the one-shot pulse produced therefrom is equal to the time at which the timer T counts the predetermined number of pulses n.

While in the embodiment described, the A.C. motor M is used as a sewing motor, other types of motors are also usable such as D.C. series commutator motor, D.C. brushless motor.

As described in detail, according to the present invention, since the rotational direction of the sewing motor is alternately reversed when the rotational speed of the sewing motor is lowered below the minimum rotational speed determined based on the minimum sewing speed, the up and down movements of the needle are repeatedly carried out so that the needle sticks into the same stitching point. Therefore, the needle can penetrate into the fabric even if it is thick. With such an arrangement, the sewing capability of the sewing machine can be enhanced without lowering the maximum driving speed and without increasing the motor output. Moreover, an undue load is not imposed on the mechanical system of the sewing machine, so the durability of the sewing motor and the sewing machine can be prolonged.

What is claimed is:

1. A rotation control device for a sewing machine, the sewing machine being driven within a predetermined range between a minimum driving speed and a maximum driving speed, comprising:
- a sewing motor rotatable at a speed in both first and second directions opposite to each other;
- rotational sped controlling means for controlling a rotational speed of said sewing motor in response to a speed instruction;
- direction instructing means for instructing a rotational direction of said sewing motor;
- detecting means for detecting the rotating speed of said sewing motor and outputting a speed signal indicative of the detected rotating speed;
- decision means for deciding whether the detected rotating speed of said sewing motor is lower than a minimum rotating speed of said sewing motor determined based on the minimum driving speed of the sewing machine and outputting a decision signal indicative of the decision made by said decision means and said decision means further comprising:
  - comparison means for comparing the rotating speed detected by said detecting means with a predetermined speed lower than the minimum rotating speed of the sewing motor; and
  - reversing/repeating means responsive to the decision signal for controlling said direction instructing means so that the rotational direction of said sewing motor is alternately reversed at a predetermined time interval.

2. The rotation control device according to claim 1, wherein said direction instructing means instructs said sewing motor to rotate in the first direction when the decision signal indicates that the rotating speed of said sewing motor is higher than the minimum rotating speed.

3. The rotation control device according to claim 2, wherein said direction instructing means comprises:.
- a first monostable multivibrator for producing a one-shot pulse having a first predetermined duration when the decision signal indicates that the rotating speed of said sewing motor is higher than the minimum rotating speed; and
- a second monostable multivibrator for producing a one-shot pulse having a second predetermine duration in response to the one-shot pulse produced from said first monostable multivibrator,
- wherein the one-shot pulse produced from said second monostable multivibrator is indicative of the rotational direction of said sewing motor.

4. The rotation control device according to claim 1, wherein said direction instructing means instructs said sewing motor to reversely rotate when the decision signal indicates that the rotating sped of said sewing motor is lower than the minimum rotating speed and a difference between the rotational speed of said sewing motor and the minimum rotating speed is greater than a predetermined minimum.

5. The rotation control device according to claim 1, wherein said direction instructing means instructs said sewing motor to reversely rotate when the decision signal indicates that the rotating speed of said sewing motor is lower than the minimum rotating speed and a current flowing in said sewing motor has reached a predetermined level.

6. A rotation control device for a sewing machine, the sewing machine being driven within a predetermined range between a minimum driving speed and a maximum driving speed, comprising:
- a sewing motor rotatable at a speed in both first and second directions opposite to each other;
- rotational speed controlling means for controlling a rotational speed of said sewing motor in response to a speed instruction;
- detecting means for detecting the rotating speed of said sewing motor and outputting a speed signal indicative of the detected rotating speed;
- decision means for deciding whether the detected rotating speed of said sewing motor is lower than a minimum rotating speed of said sewing motor determined based on the minimum driving speed of the sewing machine and outputting a decision signal indicative of the decision made by said decision means, and said decision means further comprising:
  - comparison means for comparing the rotating speed detected by said detecting means with a predetermined speed lower than the minimum rotating speed of the sewing motor;
  - direction instructing means for instructing a rotational direction of said sewing motor, said direction instructing means instructing said sewing motor to rotate in the first direction when the decision signal indicates that the rotating speed of said sewing motor is higher than the minimum rotating speed and further comprising:
    - rotational amount measuring means for measuring a predetermined rotational amount of said sewing motor in accordance with the speed signal outputted from said detecting means, and for outputting one-shot pulse signal;

time measuring means for measuring a predetermined period of time when instructed and producing a time-up signal; and logic means operatively connected to both said rotational amount measuring means and said time measuring means for producing a direction instructing signal indicative of the rotational direction of said sewing motor; and reversing/repeating means responsive to the decision signal for controlling said direction instructing means so that the rotational direction of said sewing motor is alternately reversed at a predetermined time interval.

7. The rotation control device according to claim 6, wherein said logic means activates said time measuring means to start measuring the predetermined period of time when the decision signal indicates that the rotating speed of said sewing motor falls below the predetermined speed, and instructs said sewing motor to rotate in the first direction during the measurement of the predetermined period of time by said time measuring means.

8. The rotation control device according to claim 7, wherein said logic means instructs said sewing motor to rotate in the second direction when the decision signal indicates that the rotating speed of said sewing motor falls below the predetermined speed and said time measuring means has measured the predetermined period of time.

9. The rotational control device according to claim 8, wherein said rotational amount measuring means starts measuring the predetermined rotational amount of said sewing motor when said logic means instructs said sewing motor to rotate in the second direction.

10. The rotational control device according to claim 9, wherein said logic means again activates said time measuring means to start measuring the predetermined period of time in response to the one-shot pulse signal outputted from said rotational amount measuring means.

* * * * *